US010850825B2

(12) United States Patent
Behruzi et al.

(10) Patent No.: US 10,850,825 B2
(45) Date of Patent: Dec. 1, 2020

(54) COOLING OF A VAPORIZED CONTENT OF A LIQUEFIED GAS FOR THE PURPOSE OF POWERING MACHINERY, PLANTS OR VEHICLES

(71) Applicant: ArianeGroup GmbH, Taufkirchen (DE)

(72) Inventors: Kei Philipp Behruzi, Bremen (DE); Johannes Lux, Bremen (DE)

(73) Assignee: ARIANEGROUP GMBH, Taufkirchen (DE)

( * ) Notice: Subject to any disclaimer, the term of this patent is extended or adjusted under 35 U.S.C. 154(b) by 94 days.

(21) Appl. No.: 16/042,404

(22) Filed: Jul. 23, 2018

(65) Prior Publication Data

US 2019/0054992 A1 Feb. 21, 2019

(30) Foreign Application Priority Data

Aug. 18, 2017 (DE) ..... 10 2017 118 951

(51) Int. Cl.
*F17C 7/02* (2006.01)
*B63J 2/14* (2006.01)
(Continued)

(52) U.S. Cl.
CPC *B63J 2/14* (2013.01); *F17C 3/00* (2013.01); *F17C 13/082* (2013.01); *F25J 1/0025* (2013.01); *F25J 1/0221* (2013.01); *F25J 1/0277* (2013.01); *F17C 2201/054* (2013.01); *F17C 2221/033* (2013.01);
(Continued)

(58) Field of Classification Search
CPC ... F25J 1/0025; F17C 7/02; F17C 7/04; F17C 9/02; F17C 9/04; F17C 2265/03; F17C 2265/031; F17C 2265/033034
See application file for complete search history.

(56) References Cited

U.S. PATENT DOCUMENTS 5,079,925 A 1/1992 Maric
8,113,006 B2 2/2012 Rech et al.
(Continued)

FOREIGN PATENT DOCUMENTS

AT 004606 U1 9/2001
DE 102006025656 B4 12/2007
(Continued)

OTHER PUBLICATIONS

European Search Report for corresponding European Patent Application No. 18184482.
(Continued)

*Primary Examiner* — Brian M King
(74) *Attorney, Agent, or Firm* — Greer, Burns & Crain, Ltd.

(57) ABSTRACT

A fuel system for a liquefied gas drive system. The fuel system has a liquefied gas tank and a cooling system for the vaporized content of liquefied gas, which comprises a liquid nitrogen tank, a nitrogen pump, a heat exchanger, and a nitrogen cooler, which are connected to each other in a pipework circuit. The heat exchanger is arranged in the interior of the liquefied gas tank. Also disclosed are a vehicle, a plant and a machine, in each case with a fuel system, and a method for cooling the vaporized content of liquefied gas of a liquefied gas drive system.

13 Claims, 3 Drawing Sheets

(51) Int. Cl.

| | |
|---|---|
| ***F25J 1/00*** | (2006.01) |
| ***F25J 1/02*** | (2006.01) |
| ***F17C 13/08*** | (2006.01) |
| ***F17C 3/00*** | (2006.01) |

(52) U.S. Cl.
CPC *F17C 2223/0161* (2013.01); *F17C 2223/033* (2013.01); *F17C 2223/047* (2013.01); *F17C 2225/044* (2013.01); *F17C 2227/0135* (2013.01); *F17C 2227/0341* (2013.01); *F17C 2227/0353* (2013.01); *F17C 2227/0388* (2013.01); *F17C 2250/043* (2013.01); *F17C 2250/0408* (2013.01); *F17C 2250/0439* (2013.01); *F17C 2260/021* (2013.01); *F17C 2260/031* (2013.01); *F17C 2265/03* (2013.01); *F17C 2265/034* (2013.01); *F17C 2270/0105* (2013.01); *F25J 2210/42* (2013.01); *F25J 2230/08* (2013.01)

(56) References Cited

U.S. PATENT DOCUMENTS

| | | | | |
|---|---|---|---|---|
| 8,459,013 | B2 | 6/2013 | Hosaka et al. | |
| 9,625,094 | B2 | 4/2017 | Brunner et al. | |
| 9,784,410 | B2 | 10/2017 | Brunner et al. | |
| 2004/0035120 | A1 | 2/2004 | Brunnhofer | |
| 2006/0156744 | A1* | 7/2006 | Cusiter | B63B 25/16 62/50.2 |
| 2008/0276628 | A1* | 11/2008 | Lee | B63B 25/14 62/50.2 |
| 2010/0170297 | A1* | 7/2010 | Oka | F17C 9/04 62/614 |
| 2012/0318017 | A1* | 12/2012 | Cheng | B01D 5/0006 62/601 |
| 2013/0061608 | A1 | 3/2013 | Lurken et al. | |
| 2014/0196474 | A1 | 7/2014 | Yoo et al. | |
| 2014/0311591 | A1* | 10/2014 | Drube | F04B 15/08 137/340 |
| 2015/0204604 | A1 | 7/2015 | Varrassi | |
| 2015/0300569 | A1 | 10/2015 | Baust et al. | |
| 2016/0252215 | A1 | 9/2016 | Windmeier et al. | |

FOREIGN PATENT DOCUMENTS

| | | | |
|---|---|---|---|
| DE | 102007057978 | A1 | 6/2009 |
| DE | 102010020476 | A1 | 11/2011 |
| DE | 102012204818 | A1 | 9/2013 |
| DE | 102013018333 | A1 | 4/2015 |
| EP | 0670452 | A1 | 9/1995 |
| EP | 2716542 | A2 | 4/2014 |
| EP | 2899116 | | 7/2015 |
| GB | 872660 | A | 7/1961 |
| GB | 1160245 | A | 8/1969 |
| JP | 2000266294 | A | 9/2000 |
| WO | 2015062694 | A1 | 5/2015 |
| WO | 2015197455 | A1 | 12/2015 |

OTHER PUBLICATIONS

German Search Results from German Patent Application No. 102017118951.3.

* cited by examiner

13

13

COOLING OF A VAPORIZED CONTENT OF A LIQUEFIED GAS FOR THE PURPOSE OF POWERING MACHINERY, PLANTS OR VEHICLES

CROSS-REFERENCES TO RELATED APPLICATIONS

This application claims the benefit of the German patent application No. 10 2017 118 951.3 filed on Aug. 18, 2017, the entire disclosures of which are incorporated herein by way of reference.

BACKGROUND OF THE INVENTION

The present invention relates to a fuel system for a liquefied gas drive system, wherein the fuel system has a liquefied gas tank and a cooling system for cooling a vaporized content of the liquefied gas. The invention further relates to a method for cooling a vaporized content of the liquefied gas of a liquefied gas drive system, together with a vehicle, in particular, a watercraft, a plant and a machine, which, in each case, have a liquefied gas drive system and a fuel system.

Systems that store liquefied gas (especially natural gas) or are operated with liquefied gas, as a rule have the property that heat penetrates through the tank insulation into the, as a rule, cryogenic liquid; the liquid can, for example, have a temperature of about −161° C. Ultimately, the heat that is introduced leads to a vaporization of the liquid. Among experts the vaporized content is also referred to in English as "boil off gas," in short "BOG." The additional gas content in the liquefied gas tank raises the tank pressure. Since the permissible tank pressure is limited for structural reasons, a release valve is often provided, which is opened if a maximum pressure is exceeded. The gas then flows through the release valve out of the tank and can escape through a flue into the environment. To ensure that no flammable gas enters the environment unburned, the evaporated gas that has been released into the environment via the flue is often flared off.

The release valve closes again as soon as a prescribed minimum tank pressure value is reached. After closing, the tank pressure rises once again until the maximum pressure is again reached.

The release of excess gas is essential for such a system, but it requires an environment that allows this system to operate: When the flue outlet is near an ignition source (e.g., a fire) or an ignitable gas (e.g., a gas leak), the operation of this standard system is critical. In addition, the energy generated by the vaporization process often cannot be used, so that the loss of tank content is not compensated.

From EP 2 899 116 A2 a system is of known art in which the liquefied gas or the vaporized gas is fed into a heat exchanger through which liquid nitrogen is fed. The liquefied gas or vaporized gas is thereby cooled and/or reliquefied and fed back into the tank. The nitrogen that is vaporized during the heat exchange process is discharged through a valve.

Here, however, the cooling arrangement requires a pipework system for the liquefied gas from the tank to the heat exchanger, and back again to the tank, which with its pipes and connections causes an increased susceptibility to leakage. In particular, by virtue of the flammability of the liquefied gas, the safety of the plant is thereby reduced.

SUMMARY OF THE INVENTION

The object of the present invention is to provide a technique for avoiding the release of vaporized gas that offers increased plant safety.

An inventive fuel system is provided for a liquefied gas drive system (for example, a liquid natural gas drive system), in particular for a liquefied gas drive system of a vehicle (for example, a water- or land-based vehicle), a plant (for example, a processing plant or a manufacturing plant), or a machine. It has a liquefied gas tank (for the accommodation of liquefied gas provided for the drive system, which can be natural gas, for example) and a cooling system. The latter comprises a liquid nitrogen tank, a heat exchanger, a nitrogen pump and a nitrogen cooler (for purposes of cooling nitrogen that is fed through). Here the liquid nitrogen tank, heat exchanger, nitrogen pump, and nitrogen cooler are connected to each other by pipes in a pipework circuit, so that, by means of the nitrogen pump, nitrogen from the liquid nitrogen tank can therefore circulate successively through the heat exchanger and the nitrogen cooler and back into the liquid nitrogen tank.

The heat exchanger is thereby arranged in the interior of the liquefied gas tank, so that the thermal energy from vaporization of the liquefied gas (that is to say, of the gas content of the vaporized liquefied gas) can be transferred in the liquefied gas tank to nitrogen fed through the heat exchanger.

The inventive arrangement of the heat exchanger in the interior of the liquefied gas tank enables cooling of the liquefied gas, that is to say, of the vaporized content of the liquefied gas, without the latter leaving the liquefied gas tank. Leakage-prone connections and pipes for the liquefied gas and its vaporized content can thus be avoided, which offers the advantage of increased plant safety.

The inventive configuration of the cooling system with the pipework circuit and the nitrogen cooler also enables cooling of the vaporized content of the liquefied gas in a closed system without any loss of nitrogen. Regular replenishment of nitrogen and thus a continuous provision of liquid nitrogen can thus be dispensed with, which means a reduction in the expenditure required to refuel the ship. In addition, the quantity of coolant (nitrogen) to be carried on the voyage and thus the transportation energy to be applied can in this way be reduced.

The liquid nitrogen tank, the nitrogen cooler and/or the nitrogen pump are/is preferably arranged outside the liquefied gas tank.

The pipework circuit can include a bypass pipe for the nitrogen pump, wherein the bypass pipe preferably comprises a valve. Thus, the cooling system can continue to operate in the event of a defect of the nitrogen pump (which is, for example, pressure controlled).

The nitrogen cooler is preferably arranged behind the heat exchanger in an intended pumping direction (that is to say, an intended flow direction for the nitrogen) and is configured for the purpose of cooling down again the nitrogen heated in the heat exchanger (in the liquefied gas tank) by the vaporized content of the liquefied gas.

The nitrogen cooler can, in particular, be configured so as to be electrically operated. The fuel system can comprise a power generator that provides the power for the nitrogen cooler. Such a power generator, which can be arranged in a vehicle in accordance with the invention, or a plant in accordance with the invention, for example in the tank chamber, can, in particular, be configured so as to be operated with the liquefied gas, so that the cooling capacity is then obtained from the liquefied gas itself. (In the ideal, loss-free system, the energy needed for the cooling process would correspond to the energy of the vaporized gas.)

A vehicle in accordance with the invention (which, in particular, can be a watercraft or a land vehicle) has a liquefied gas drive system and—for purposes of providing the liquefied gas for the drive system—an inventive fuel system in accordance with one of the embodiments disclosed in this document.

Analogously, a plant in accordance with the invention (which can be, for example, a processing plant or a manufacturing plant), or a machine in accordance with the invention, has a liquefied gas drive system and—for purposes of providing the liquefied gas for the drive system—an inventive fuel system in accordance with one of the embodiments disclosed in this document.

In each case, the liquefied gas drive system can, in particular, be a liquid natural gas drive system.

In accordance with an advantageous development, the cooling system of an inventive fuel system has an outlet for the nitrogen heated in the heat exchanger. Here the outlet, to which the heat exchanger is preferably connected by a pipe that bypasses the nitrogen cooler, can be closed and opened (for example, as a function of pressure, e.g., by means of a pressure relief valve).

In particular, such an outlet allows optional operation of the cooling system (e.g., in the event of a failure of the nitrogen cooler or the pump) as an open system in which the nitrogen, after it has absorbed the heat from the vaporized content of the liquefied gas, is not fed through the nitrogen cooler and re-cooled, but rather is discharged directly via a pipe through the outlet. In this case, the nitrogen is thus discharged in gaseous form into the environment. Depending on the quantity of nitrogen stored in the liquid nitrogen tank, the system can continue to be operated for a certain time (e.g., of the order of several days). During this period, either a repair of the cooling system or the defective component(s), or an appropriate hazard protection procedure, should be undertaken.

In accordance with an advantageous embodiment, the cooling system also comprises a compressed nitrogen gas reservoir, which is connected via a pipe (which can comprise a preferably controllable valve) to the liquid nitrogen tank. This enables the control of an operating pressure in the liquid nitrogen tank: The vaporization temperature of the vaporizing nitrogen then changes with the operating pressure. The system therefore enables the pressure to control the vaporization energy and thus the cooling capacity of the heat exchanger.

To limit a maximum pressure in the pipework circuit (especially in the liquid nitrogen tank), the cooling system preferably has a pressure relief outlet. Through the latter, nitrogen can then be released from the cooling system as a function of pressure.

In an orientation of the liquefied gas tank intended for operational conditions, the heat exchanger is preferably arranged in a headspace of the liquefied gas tank, that is to say, above the liquid level (in particular, above an intended maximum fill level) of the liquefied gas. In such an orientation of the liquefied gas tank, the heat exchanger can, in particular, be preferably arranged in an uppermost quarter, or even an uppermost sixth, of the interior space of the liquefied gas tank.

In accordance with an advantageous embodiment, the heat exchanger has a multiplicity of cooling tubes through which the nitrogen is fed (from the pipework circuit). The plurality of cooling tubes preferably has a common feed pipe and/or a common discharge pipe, so that a nitrogen flow that is fed through is at first divided in the cooling tubes and is merged again behind the cooling tubes (in the flow direction).

The multiplicity of cooling tubes can, in particular, comprise at least two cooling tubes, at least sections of which extend along a respective ring about a common central axis. Here the respective rings of the two or more cooling tubes can be arranged one above the other in the direction of the common central axis, and can thus form a plurality of layers (and can, for example, have the same radius). Alternatively, or additionally, the multiplicity of tubes can comprise at least two cooling tubes, at least sections of which extend along a respective ring about a common central axis, wherein the respective rings have different radii and the cooling tubes are arranged in a common layer (so that at least one ring therefore runs externally around another ring).

In an orientation of the liquefied gas tank intended for operational conditions, the common central axis preferably runs essentially vertically.

The multiplicity of cooling tubes preferably forms at least one gap through which the vaporized gas in the liquefied gas tank can flow between a plurality of the cooling tubes. By this means, particularly effective cooling can be achieved.

In accordance with an advantageous development, the heat exchanger comprises at least one drip tray for the vaporized content of the liquefied gas that has condensed on the heat exchanger. In particular, the at least one drip tray can be arranged on a lowermost cooling tube of the heat exchanger—with reference to an orientation of the liquefied gas tank intended for operational conditions. In particular, it can, for example, be designed to be at least partially in the form of a ring, following the profile of at least one of the cooling tubes (e.g., a lowermost tube).

In accordance with a preferred embodiment, an inventive fuel system has at least one extraction system with a flue, wherein the liquefied gas tank is connected to the extraction system via at least one pipe. Here the pipe can comprise a pressure relief valve. Thus, an exceedance of the maximum tank pressure in the liquefied gas tank can be prevented (especially in the event of a fault) by releasing vaporized gas from the liquefied gas tank through the extraction system.

The cooling system can also be connected to the extraction system (via a suitable pipe). In particular, the above-cited outlet for nitrogen heated in the heat exchanger and/or the pressure relief outlet (for nitrogen) can lead into the extraction system for the liquefied gas tank, or into a separate extraction facility (where appropriate, respectively or collectively).

Analogously, a liquefied gas drive system of a vehicle in accordance with the invention, or a plant or machine in accordance with the invention, can have its own extraction facility, or can be connected to the extraction system cited for the liquefied gas tank.

In accordance with a preferred embodiment, the extraction system has at least one burner for systematic flaring of discharged gas (which, in particular, can be vaporized gas from the liquefied gas tank or—in the event of an appropriate connection—gas used in the operation of the drive system). In an orientation of the extraction system intended for operational conditions, the burner is preferably located in an upper third, more preferably in an upper eighth, or even an upper tenth, of the flue.

To avoid a flashback of burning gas into the liquefied gas tank, the extraction system preferably has a deflagration flame arrester. It prevents the explosive propagation of flames back into the liquefied gas tank.

In accordance with an advantageous embodiment, an inventive fuel system has an extraction system, and also a nitrogen purge system for feeding nitrogen into the extraction system. For this purpose, the nitrogen purge system can comprise a nitrogen reservoir, for example at least one compressed nitrogen gas cylinder; here the nitrogen reservoir can be wholly or partially coincident with the above-cited compressed nitrogen gas reservoir of the cooling system, or can be a separate nitrogen reservoir. The nitrogen purge system preferably has at least one valve and/or at least one pressure regulator. In the event that the nitrogen cooling system fails, and as a last resort, flammable vaporized gas must be discharged, with the aid of the nitrogen purge system this flammable gas can be displaced by, or diluted with, nitrogen and thus released in a non-flammable concentration. Thus, the combination of cooling system, nitrogen purge system and extraction system can provide redundancy that can compensate for the failure of one part (e.g., an individual component) of the fuel system. Thus, in the event of a fault, safe operation can be ensured, at least for a limited period of time, without the vaporized gas reaching the environment in a dangerous concentration.

An inventive fuel system preferably has a pressurization system for the liquefied gas tank, which comprises a further heat exchanger (for better distinctiveness also referred to here as a "vaporization heat exchanger") for purposes of vaporizing liquefied gas from the liquefied gas tank, together with a pipe for purposes of introducing vaporized liquefied gas into the liquefied gas tank. By this means, the pressure in the liquefied gas tank can be increased in a systematic manner.

A method in accordance with the invention serves to provide cooling for the vaporized content of the liquefied gas of a liquefied gas drive system. Here, the liquefied gas (which can, in particular, be liquid natural gas) is arranged in a liquefied gas tank of an inventive fuel system in accordance with one of the embodiments disclosed in this document, and the method comprises the feeding of nitrogen through the heat exchanger located in the liquefied gas tank.

In accordance with a development of the inventive method, the fuel system is designed with the above-cited outlet that can be closed or opened for nitrogen heated in the heat exchanger. The method can then comprise, in a first phase, the feeding of nitrogen through the pipework circuit of the cooling system with the outlet closed, and, in a second phase (for example, after the pump or nitrogen cooler has failed), the feeding of nitrogen from the liquid nitrogen tank through the heat exchanger and to the (open) outlet, preferably bypassing the nitrogen cooler. Opening of the outlet can, in particular, after the occurrence of a fault, take place in a pressure-controlled manner, e.g., by means of a pressure relief valve.

Analogously, the fuel system can have a pressure relief outlet for purposes of limiting a maximum pressure in the pipework circuit of the fuel system, and the method in the second phase can comprise a release of nitrogen through the pressure relief outlet.

In accordance with an advantageous embodiment of an inventive method, the fuel system, as mentioned above, comprises an extraction system and a nitrogen purge system. In this variant, the method comprises, during a first period of time, the cooling of vaporized gas by means of the cooling system and, during a second period (for example, after a failure of the cooling system), a venting of vaporized gas through the extraction system. In the case where the extraction system comprises a burner, the method can include flaring of the vaporized gas during the second period of time.

In the advantageous case in which the fuel system comprises a nitrogen purge system in addition to the extraction system, the process can comprise a dilution of the vaporized gas in the extraction system to a non-flammable concentration by the introduction of nitrogen from the nitrogen purge system into the extraction system.

BRIEF DESCRIPTION OF THE DRAWINGS

In what follows, preferred embodiments of the invention will be described in more detail with the aid of figures. It is to be understood that individual elements and components shown are not necessarily included, and/or can be combined in a manner that differs from that illustrated.

Reference symbols for corresponding elements are used across the figures and are not necessarily described anew for each figure.

Figure 1:
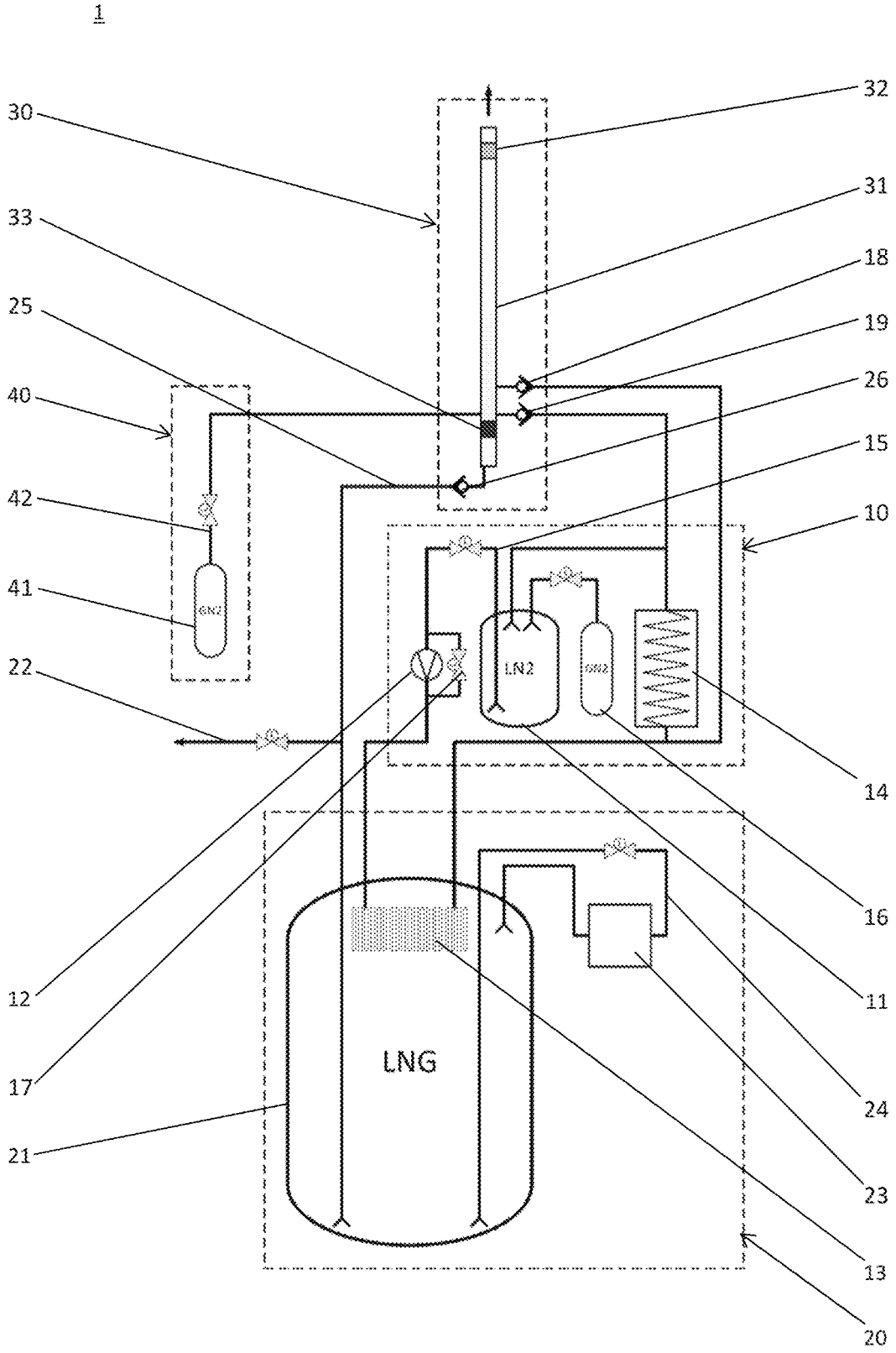
Figure 2A:
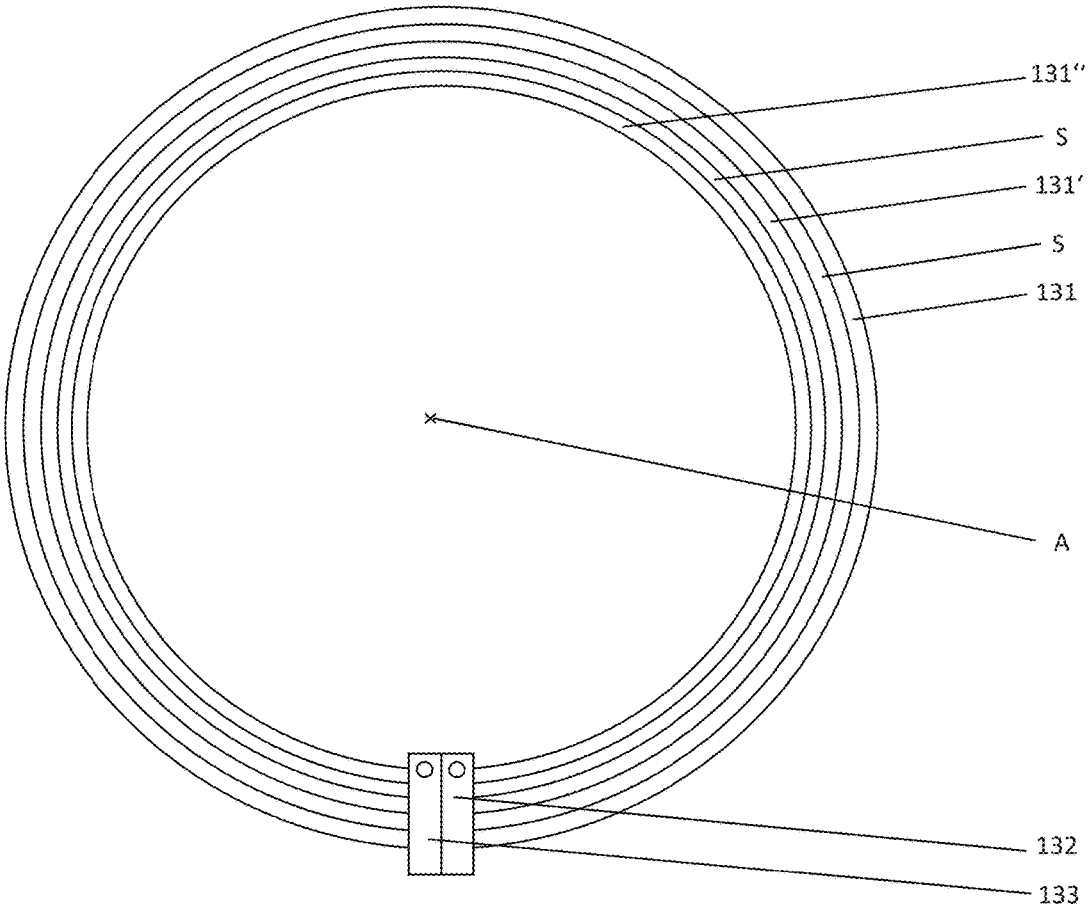
Figure 2B:
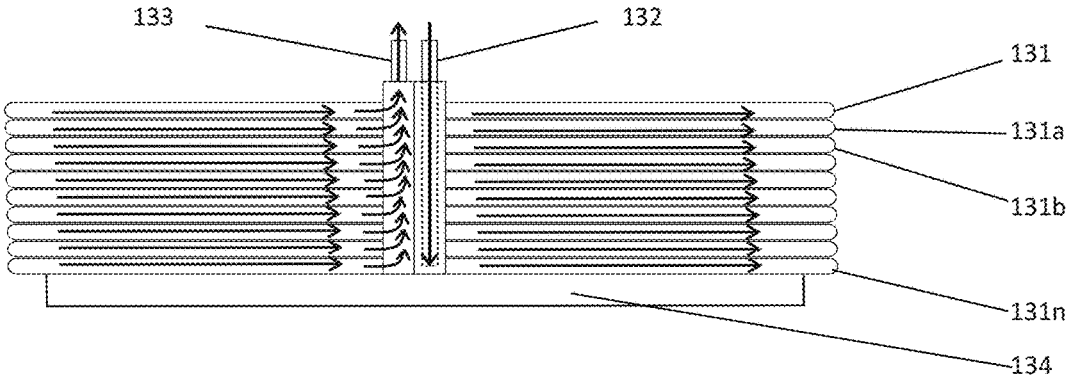
Figure 3:
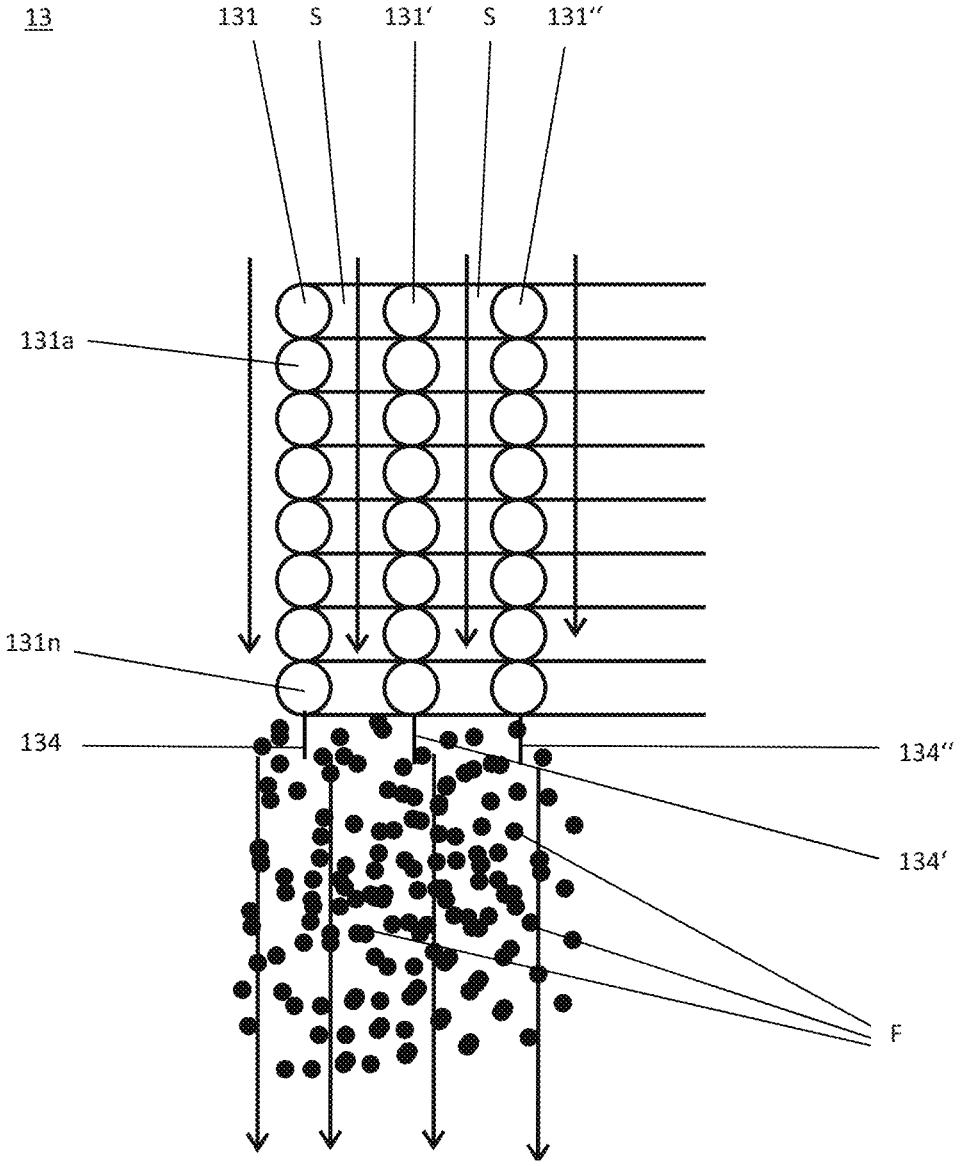

Here, in schematic form:

FIG. 1 shows an exemplary embodiment of a fuel system in accordance with the invention;

FIG. 2*a* shows a view of a heat exchanger of one embodiment of an inventive fuel system;

FIG. 2*b* shows a view from another perspective of the heat exchanger shown in FIG. 2*a*; and FIG. 3 shows a detail of a cross-sectional view of a heat exchanger of a variant when functioning.

DETAILED DESCRIPTION OF THE PREFERRED EMBODIMENTS

FIG. 1 schematically illustrates an exemplary embodiment of an inventive fuel system 1 in an orientation intended for operational conditions. The fuel system 1, which is, or can be, installed in a vehicle (e.g., a water or land vehicle), or in a plant or machine (in each case) with a liquefied gas drive system, comprises a cooling system 10 and a tank chamber 20 with a liquefied gas tank 21. The latter is configured so as to be connected via a pipe 22 to a drive system (not shown), or is already connected to the latter.

The cooling system 10 has a liquid nitrogen tank 11, a nitrogen pump 12, a heat exchanger 13, and a nitrogen cooler 14, which are interconnected in a pipework circuit. Via a pipe with a (preferably controllable) valve, the liquid nitrogen tank 11 is connected to a compressed nitrogen gas reservoir 16, which in the present case is designed as a compressed nitrogen gas cylinder. With the aid of the compressed nitrogen gas reservoir 16, an operating pressure can be set in the liquid nitrogen tank 11, which determines the cooling capacity of the heat exchanger 13.

The heat exchanger 13 is arranged in the interior of the liquefied gas tank 21, in particular in an upper region, above a liquid level (not shown) of the liquefied gas contained in the tank, so that a vaporized gas content can flow around the heat exchanger 13 and can condense on it.

The nitrogen pump 12 is configured so as to circulate nitrogen through the pipework circuit. It is connected via a pipe 15 comprising a valve with the liquid nitrogen tank 11 and in the present case can be bypassed (in particular in the event of a defect of the nitrogen pump) by a pipe 17 with a valve.

The nitrogen cooler 14 can, for example, be electrically operated, for example by means of a power generator (not shown), which in turn can be operated with liquefied gas from the liquefied gas tank 21.

The fuel system 1 as illustrated, furthermore, has a pressurization system, which in the present case is arranged in the tank chamber 20 for the liquefied gas tank; this comprises a vaporization heat exchanger 23 for purposes of vaporizing liquefied gas from the liquefied gas tank, together with a pipe 24 (with a valve) for purposes of introducing vaporized liquefied gas into the liquefied gas tank.

The liquefied gas tank 21 is connected to an extraction system 30 via a pipe 25 with a pressure relief valve 26. If a prescribed maximum pressure in the liquefied gas tank 21 is exceeded, vaporized gas can be released in this manner into the environment, as indicated in the figure by an arrow.

The extraction system includes a flue 31, in the upper eighth of which is arranged a burner 32 for the systematic flaring of vaporized gas. A deflagration flame arrester 33 is arranged in the flue 31 between the liquefied gas tank 21 and the burner 32; this is intended to prevent any flashback of flames into the liquefied gas tank 21.

In addition, the fuel system 1 in the embodiment shown comprises a nitrogen purge system 40 with a nitrogen reservoir 41, which in the present case comprises a compressed gas cylinder and via a pipe 42 (which comprises at least one valve) is connected to the extraction system 30. Nitrogen can thus be fed through the pipe 42 to the extraction system, in particular to the flue 31, and at the same time, if necessary, vaporized gas that has been introduced can be diluted to a non-flammable concentration. The nitrogen purge system thus provides additional safety for the fuel system.

In the present embodiment, the fuel system, to increase safety by means of redundancy, comprises both the nitrogen purge system 40 and the burner 32; in alternative embodiments, neither, or just one, of these two units is included.

The cooling system 10 comprises an outlet 18 for nitrogen heated in the heat exchanger 13 and a pressure relief outlet 19 for purposes of limiting a maximum pressure in the pipework circuit (in particular in the liquid nitrogen tank); in the present case these are both designed as pressure relief valves and lead into the flue 31 of the extraction system 30. Via the outlet 18, the fuel system 1 can be operated as an open system, bypassing the nitrogen cooler 14, for example in the event of a defect of the nitrogen cooler 14 or the pump 12, for a period of time until a repair can be made.

FIGS. 2*a* and 2*b* show, in two different perspectives, an exemplary heat exchanger 13 which is used in an advantageous variant of an embodiment of an inventive fuel system 1: In an orientation of the liquefied gas tank intended for operational, FIG. 2*a* shows the heat exchanger from above, the viewing direction onto the figure thus runs vertically, whereas FIG. 2*b* shows the heat exchanger 13 from the side, that is to say, with a horizontal viewing direction onto the figure.

The heat exchanger 13 has a multiplicity of cooling tubes 131, 131', 131", 131*a*, 131*b*, . . . , 131*n*, through which nitrogen can pass; these run along a respective ring about a common central axis A, which in FIG. 2*a* runs in the viewing direction and therefore can only be seen as a point. It is to be understood that the number of cooling tubes illustrated in each case is purely exemplary.

The respective rings of the cooling tubes visible in FIG. 2*a* have different radii, the cooling tube 131 therefore runs as a ring around the cooling tube 131' and the latter in turn runs as a ring around the cooling tube 131". Here the three cooling tubes 131, 131' and 131" are arranged in a common layer, that is to say, they are not offset relative to one another along the central axis A. Gaps S are formed (also running coaxially) between the cooling tubes 131, 131' and 131", through which the vaporized gas can flow.

The cooling tubes 131, 131*a*, 131*b*, 131*n*, and the cooling tubes not provided with reference symbols, shown in FIG. 2*b*, on the other hand, are stacked one above another in the direction of the central axis, and thus form a plurality of layers. Here the respective rings in the present case all have the same radius.

The cooling tubes 131, 131', 131", 131*a*, 131*b*, . . . , 131*n* have a common feed pipe 132 and a common discharge pipe 133, through which nitrogen can be introduced and removed respectively. With regard to the flow of nitrogen therefore, the cooling tubes are connected in parallel. In FIG. 2*b* the intended flow direction for the nitrogen is indicated by arrows.

A drip tray 134 is arranged on the lowest cooling tube in the present case 131*n*; this follows the circular path of the cooling tube 131*n* and extends vertically. Condensed vaporized gas can drain onto the drip tray 134.

Such a draining process is illustrated in FIG. 3, which shows a section of the heat exchanger 13 in a cross-sectional view when functioning: As indicated by arrows, the vaporized gas, as it continues to cool, flows from top to bottom through the gaps S between the stacked cooling tubes until it is condensed in the region of the lowest cooling tube layer (with cooling tube 131*n* and other cooling tubes lying further inwards with respect to the central axis). The lowermost cooling tubes have in each case a vertically extending drip tray 134, 134', 134" in the form of a ring, onto which the liquid droplets F fall from the condensed vaporized gas.

Disclosed is a fuel system 1 for a liquefied gas drive system. The fuel system has a liquefied gas tank 21 and a cooling system 10 for the vaporized content of the liquefied gas, which comprises a liquid nitrogen tank 11, a nitrogen pump 12, a heat exchanger 13, and a nitrogen cooler 14, which are connected to each other in a pipework circuit. The heat exchanger 13 is arranged in the interior of the liquefied gas tank 21.

Also disclosed are a vehicle, a plant and a machine, in each case with a fuel system 1, and a method for cooling the vaporized content of the liquefied gas of a liquefied gas drive system.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

REFERENCE SYMBOLS

1 Fuel system
10 Cooling system
11 Liquid nitrogen tank
12 Nitrogen pump
13 Heat exchanger
14 Nitrogen cooler
15 Pipe
16 Compressed nitrogen gas reservoir
17 Pipe
18 Outlet for nitrogen heated in the heat exchanger 13
19 Pressure relief outlet
20 Tank chamber
21 Liquefied gas tank
22 Pipe to a drive system (not shown)

23 Vaporization heat exchanger
24 Pipe
25 Pipe
26 Pressure relief valve
30 Extraction system
31 Flue
32 Burner
33 Deflagration flame arrester
40 Nitrogen purge system
41 Nitrogen reservoir
42 Pipe
131, 131', 131", 131*a*, 131*b*, . . . , 131*n* Cooling tube
132 Feed pipe
133 Discharge pipe
134, 134', 134" Drip tray
A Central axis
F Fluid droplets
S Gap

The invention claimed is:

1. A fuel system for a liquefied gas drive system, comprising:
a liquefied gas tank; and
a cooling system,
wherein the cooling system comprises a liquid nitrogen tank, a nitrogen pump, a heat exchanger, and a nitrogen cooler, which are connected to each other in a pipework circuit, and
wherein the heat exchanger is arranged in an interior of the liquefied gas tank,
further comprising at least one extraction system with a flue, to which the liquefied gas tank is connected via at least one pipe configured to discharge gas from the liquefied gas tank through the flue,
wherein at least one of:
the cooling system further has at least one of an outlet that is likewise connected to the flue and that can be closed or opened for discharging nitrogen heated in the heat exchanger through the flue, or a pressure relief outlet connected to the flue to limit a maximum pressure in the pipework circuit by discharge through the flue, or
the fuel system further comprises a nitrogen purge system connected to the flue to feed nitrogen into the flue.

2. The fuel system in accordance with claim 1, wherein the heat exchanger has a multiplicity of cooling tubes through which nitrogen can be fed.

3. The fuel system in accordance with claim 2, wherein the multiplicity of cooling tubes comprises at least two cooling tubes, at least sections of which extend along a respective ring about a common central axis.

4. The fuel system in accordance with claim 1, wherein the at least one extraction system comprises at least one burner to flare discharged gas.

5. The fuel system in accordance with claim 1, further comprising a pressurization system for the liquefied gas tank, which comprises a vaporization heat exchanger to vaporize liquefied gas from the liquefied gas tank, together with a pipe to introduce vaporized liquefied gas into the liquefied gas tank.

6. The fuel system in accordance with claim 1, wherein the cooling system comprises a compressed nitrogen gas reservoir which is connected via a pipe to the liquid nitrogen tank.

7. A vehicle with a liquefied gas drive system, comprising a fuel system in accordance with claim 1, to provide liquefied gas for the drive system.

8. A plant or machine with a liquefied gas drive system, wherein for provision of liquefied gas for a drive system, the plant or machine has a fuel system in accordance with claim 1.

9. A method for cooling vaporized content of a liquefied gas of a liquefied gas drive system, wherein
the liquefied gas is arranged in a liquefied gas tank of a fuel system in accordance with claim 1, and wherein
the method comprises feeding nitrogen through the heat exchanger located in the liquefied gas tank.

10. The method in accordance with claim 9, wherein the cooling system has at least one of
an outlet that can be closed or opened for nitrogen heated in the heat exchanger, or
a pressure relief outlet to limit a maximum pressure in the pipework circuit, and
the method comprises:
in a first phase, feeding nitrogen through the pipework circuit of the cooling system with the outlet and pressure relief outlet closed, and
in a second phase, releasing nitrogen through the outlet for nitrogen heated in the heat exchanger, or the pressure relief outlet.

11. The method in accordance with claim 9, wherein the method comprises:
during a first period of time, cooling vaporized gas by means of the cooling system, and
during a second period of time, venting vaporized gas through the extraction system.

12. A fuel system for a liquefied gas drive system, comprising:
a liquefied gas tank; and
a cooling system,
wherein the cooling system comprises a liquid nitrogen tank, a nitrogen pump, a heat exchanger, and a nitrogen cooler, which are connected to each other in a pipework circuit, and
wherein the heat exchanger is arranged in an interior of the liquefied gas tank,
further comprising at least one extraction system with a flue, to which the liquefied gas tank is connected via at least one pipe configured to discharge gas from the liquefied gas tank through the flue,
wherein the cooling system further has a pressure relief outlet connected to the flue, to limit a maximum pressure in the pipework circuit by discharge through the flue.

13. A fuel system for a liquefied gas drive system, comprising:
a liquefied gas tank; and
a cooling system,
wherein the cooling system comprises a liquid nitrogen tank, a nitrogen pump, a heat exchanger, and a nitrogen cooler, which are connected to each other in a pipework circuit, and
wherein the heat exchanger is arranged in an interior of the liquefied gas tank,
further comprising at least one extraction system with a flue, to which the liquefied gas tank is connected via at least one pipe configured to discharge gas from the liquefied gas tank through the flue, the fuel system further comprising a nitrogen purge system connected to the flue to feed nitrogen into the flue.

* * * * *